US009637938B2

(12) United States Patent
Berger et al.

(10) Patent No.: US 9,637,938 B2
(45) Date of Patent: May 2, 2017

(54) ASSEMBLY OF FORMWORK, AND GRADUATED ANCHORING SYSTEM

(71) Applicant: Hunnebeck GmbH, Ratingen (DE)

(72) Inventors: Martin Berger, Nettetal (DE); Volker Klehr, Viersen (DE); Klaus Hagemes, Viersen (DE)

(73) Assignee: Hünnebeck GmbH, Ratingen (DE)

( * ) Notice: Subject to any disclaimer, the term of this patent is extended or adjusted under 35 U.S.C. 154(b) by 33 days.

(21) Appl. No.: 14/415,679

(22) PCT Filed: Apr. 12, 2013

(86) PCT No.: PCT/EP2013/057692

§ 371 (c)(1),
(2) Date: Jan. 19, 2015

(87) PCT Pub. No.: WO2014/012685

PCT Pub. Date: Jan. 23, 2014

(65) Prior Publication Data

US 2015/0176634 A1 Jun. 25, 2015

(30) Foreign Application Priority Data

Jul. 18, 2012 (DE) ..... 10 2012 212 607
Feb. 22, 2013 (EP) ..... PCT/EP2013/053551

(51) Int. Cl.
*E04G 17/065* (2006.01)
*E04G 19/00* (2006.01)
(Continued)

(52) U.S. Cl.
CPC ..... *E04G 17/007* (2013.01); *E04G 17/02* (2013.01); *E04G 17/0652* (2013.01);
(Continued)

(58) Field of Classification Search
CPC ..... Y10T 29/49828; E04G 17/0601; E04G 17/0605; E04G 17/065; E04G 17/0652; E04G 19/00; E04G 19/1903
(Continued)

(56) References Cited

U.S. PATENT DOCUMENTS 3,327,988 A 6/1967 Bridges
3,981,476 A 9/1976 Alexander et al.
(Continued)

FOREIGN PATENT DOCUMENTS

DE 1974244 U 12/1967
DE 3604252 A1 2/1986
(Continued)

OTHER PUBLICATIONS

International Search Report for corresponding patent application No. PCT/EP2013/0057692 dated Sep. 17, 2013.

*Primary Examiner* — Michael Safavi
(74) *Attorney, Agent, or Firm* — Renner, Otto, Boiselle & Sklar, LLP

(57) ABSTRACT

The invention relates to an anchoring system for a wall formwork and to a method for an assembly of the anchoring system: • the two wall formworks (1, 2, 3, 40) are set up opposite from each other, • an anchoring rod (4) with a graduation (21) is pushed through anchoring rod bores of the two wall formworks (1, 2, 3, 40) in such a way that the end of the anchoring rod (4) that has not been pushed through has the graduation (21), • the pushed-through end of the anchoring rod (4) is connected to a locking device (41) present on the rear side of the one formwork (40), • the end of the anchoring rod (4) that has not been pushed through is connected to the locking device (5, 6, 7, 8, 13, 14, 15) provided here in such a manner that this connection is aligned with the selected graduation, • the locking device aligned with the graduation is connected to the adjacent wall formwork (1, 2, 3).

7 Claims, 5 Drawing Sheets

(51) Int. Cl.
*E04G 17/00* (2006.01)
*E04G 17/02* (2006.01)
*E04G 9/02* (2006.01)

(52) U.S. Cl.
CPC ..... *E04G 17/0657* (2013.01); *E04G 19/00* (2013.01); *E04G 2009/028* (2013.01); *E04G 2017/008* (2013.01)

(58) Field of Classification Search
USPC ..... 29/428; 249/40, 41, 46, 190, 191, 213, 249/216
See application file for complete search history.

(56) References Cited

U.S. PATENT DOCUMENTS

| | | | |
|---|---|---|---|
| 4,018,023 | A | 4/1977 | Anderson |
| 2008/0307735 | A1 | 12/2008 | Trimmer |
| 2012/0304570 | A1 | 12/2012 | Braun et al. |

FOREIGN PATENT DOCUMENTS

| | | | |
|---|---|---|---|
| DE | 103 36 414 | A1 | 3/2005 |
| DE | 10 2004 001 091 | A1 | 8/2005 |
| DE | 10 2010 002108 | A1 | 8/2011 |
| EP | 1 975 337 | A1 | 10/2008 |
| WO | 2005/066434 | A1 | 7/2005 |
| WO | 2008/089737 | A1 | 7/2008 |

ASSEMBLY OF FORMWORK, AND GRADUATED ANCHORING SYSTEM

FIELD OF THE INVENTION

The invention relates to a method for assembling a wall formwork as well as to an anchoring system for a wall formwork for carrying out the method.

BACKGROUND OF THE INVENTION

An anchoring system within the sense of the present invention is used in formwork engineering when concreting reinforced concrete structures in order to install wall formworks. A wall formwork comprises a formwork facing on the front and elements supporting the formwork facing on the back, such as longitudinal beams, crossbars and frames. In the erected state of a wall formwork, a longitudinal beam extends in the vertical direction and a crossbar in the horizontal direction.

The two sides of a wall to be concreted are delimited by wall formworks. With its formwork facing, the front of each wall formwork in that case adjoins the concrete. Wall formworks facing each other are generally retained by a plurality of anchoring systems. The anchoring rods are pushed through openings in the wall formworks and attached at their ends by means of locking devices to the elements supporting the respective formwork facing in such a way that at least the tensile force acting upon the anchoring rods during concreting is absorbed. These openings that pass through the wall formworks are also referred to as anchoring rod bores.

Formwork engineering differentiates between a holding formwork and a closing formwork. A holding formwork is a wall formwork which is erected first. Subsequent thereto, the closing formwork is erected opposite from the holding formwork. The holding formwork and the closing formwork are connected to each other during assembly by means of one or more anchoring systems. Concrete is poured into the intermediate space between the holding formwork and the closing formwork. The hardening of the concrete creates a wall.

Usually, one or both ends of an anchoring rod comprise a threaded portion onto which nuts are screwed as anchor fixation members. The middle region of such an anchoring rod, to which concrete can adjoin during concreting, advantageously either has a smooth surface or is enveloped at least during concreting by a sleeve having a smooth surface. Otherwise, a threaded portion of an anchoring rod would be covered in concrete. In that case, the anchoring rod could no longer be pulled out of the hardened concrete without any trouble.

The maximum effective length of the anchoring rod, and thus the thickness of the wall to be concreted, is therefore determined, as a rule, by the length of the middle anchoring rod region with a smooth surface. At the same time, the pressure exerted by the liquid concrete on the formwork facing during concreting is diverted via the nuts onto the anchoring rods. In the process, the anchoring rods are subjected to tensile stress.

Spacers can be introduced between the formwork facings into the volume of the wall to be concreted, which are able to absorb compression forces arising during concreting, whereby it is ensured that these compression forces do not affect, i.e. reduce, the wall thickness in an undesirable manner. Alternatively or additionally, the locking devices can be attached to the wall formworks so that they are also able to absorb compression forces.

If the concrete that has been poured between two wall formworks has hardened, the anchoring rod is disengaged from a locking device and pulled out of the concrete wall. If necessary, the top side of a closing formwork is suspended from a hook of a crane prior to this, so that it does not fall over once all anchoring rods have been pulled out. Finally, the wall formworks are shifted in a suitable manner, for example by means of the crane, in order to produce a next wall or a next wall portion. If the wall formworks have been shifted, then the anchoring systems are again mounted or attached to the wall formworks.

From the printed publication WO 2008/089737 A1, an anchoring system is known with two locking devices and an anchoring rod for a wall formwork with a first and a second formwork element. On its two ends, the anchoring rod has one threaded portion, respectively, which are screwed into nut members of the locking devices. Each locking device comprises a dome plate that is attached to a rear side of a wall formwork by means of attachment means. Therefore, the anchoring system is capable of absorbing both tensile as well as compression forces of a wall formwork.

Unless otherwise stated below, the above-mentioned features, which are known from the prior art, can be combined, individually or in any combination, with the subject matter of the invention described below.

SUMMARY OF THE INVENTION

It is the object of the invention to simplify the assembly of a wall formwork and to provide an anchoring system for this purpose.

The object of the invention is accomplished by a method having the features of the first claim and by an anchoring system having the features of the co-ordinated claim. Advantageous embodiments are apparent from the dependent claims. A co-ordinated claim relates to a stop for the anchoring system.

In order to simplify and accelerate an assembly, the anchoring rod of an anchoring system, on the end that is not pulled out through the wall formwork for dismantling, or, conversely, is pushed into anchoring rod bores for assembly, comprises a graduation for producing walls of different thicknesses. By assembling anchoring systems with a graduation, it is possible in a simple and exact manner to set a wall thickness provided in accordance with the graduation. Providing a graduation in an anchoring system makes it possible to accelerate and simplify an assembly process.

The anchoring rod is first pushed through anchoring rod bores of the closing and holding formwork, and the pushed-through end is connected, in particular screwed, to a locking device. This locking device is preferably firmly mounted to the rear side of the corresponding wall formwork, for example screwed to a longitudinal beam of this wall formwork. Preferably, this wall formwork is a holding formwork in order thus to be able to carry out an assembly particularly quickly. The anchoring rod is connected, for example screwed, to the locking device at a predetermined position. In order to find the predetermined position quickly and simply, there is preferably a stop. If the pushed-through end of the anchoring rod reaches the stop, the predetermined position has been reached. In the case of a screw connection, the stop prevents further insertion by screwing. In this embodiment, the anchoring rod is thus screwed into the threaded portion of the locking device in the maximally possible manner.

Subsequent thereto, the end of the anchoring rod that has not been pushed through is connected, on the opposite side, with the locking device provided here, in such a way that this connection is aligned with the selected graduation. Thus, the desired distance between the two formworks is set particularly quickly and easily. The wall with the desired thickness can be poured once both locking devices contact the respective rear wall, i.e. basically the rear wall of a supporting element. If the locking devices are firmly mounted to the respective wall formwork, then they contact the rear side of the respective wall formwork.

In one embodiment, an adjusting member, which is positioned in accordance with the graduation, is provided for alignment with a graduation. In a simple embodiment, the adjusting member is an adjusting screw that is moved into a position in accordance with the graduation by screwing. Alternatively, the adjusting member can be a sleeve through which the anchoring rod has been pushed.

As a graduation, the anchoring rod can comprise a plurality of bores that have a distance from each other. If, in one embodiment, the adjusting member is located in a position in accordance with the graduation, the adjusting member is fixated in a simple embodiment by means of a cotter pin, a screw or a bolt. For example, the bolt or cotter pin is pushed for fixation through a hole of the adjusting member and the bore in the anchoring rod in such a way that the adjusting member can thus no longer be released from its position. The adjusting member and/or the bores in the anchoring rod can comprise a threaded portion in order to fixate the adjusting member by means of a screw.

If the adjusting member is located in a position in accordance with the graduation, the adjusting member is indirectly or directly connected to the rear side of the adjacent wall formwork. The wall formwork is thus moved into the position required for producing a wall of a desired wall thickness.

In order to connect the adjusting member to the rear side of a wall formwork, one or more screws, for example, can be provided which lead through suitably disposed holes in the adjusting member and are screwed into threaded portions provided for this purpose on the rear side of the adjacent formwork.

The part of an anchoring system that is pulled out for dismantling a wall formwork basically comprises, in addition to the anchoring rod, a locking device or at least a part thereof. For assembly, the anchoring rod is pushed through anchoring rod bores of the closing and holding formworks. If the above-mentioned locking device or a part thereof has not been disengaged from the anchoring rod, this locking device or the corresponding part thereof is connected to the anchoring rod when the anchoring rod is pushed through the above-mentioned anchoring rod bores for assembly. This part of the locking device, which is preferably not disengaged from the anchoring rod during assembly and dismantling, basically comprises the adjusting member. The assembly and dismantling processes can thus be carried out particularly quickly.

In the mounted state, each locking device rests against the rear side of a wall formwork in order to absorb forces. The locking device that is connected with the pushed-through end of the anchoring rod is preferably attached to the rear side of a holding formwork. The other locking device which, for dismantling, is disengaged entirely or partially from the wall formworks together with the anchoring rod is preferably provided on the rear side of a closing formwork in order to optimize a dismantling process.

In an advantageous embodiment, each locking device is attached to the rear side of the wall formwork, for example by means of a screw, so that the anchoring system is capable of absorbing both compression forces as well as tensile forces. A locking device can be firmly connected to the anchoring rod. Advantageously, however, each locking device is disengageably connected to the anchoring rod, particularly by means of a screw connection, in order to be able to optimize effective lengths of the anchoring rod.

A locking device, preferably every locking device, of the anchoring system can preferably be disengaged from the anchoring rod and/or attached in different position to one end, respectively, of the anchoring rod, e.g. by means of screwing, in order to optimize effective lengths of the anchoring rod. Preferably, each locking device has an attachment member for attaching the locking device to a wall formwork. In particular, the attachment member includes a screw with which a locking device can be screwed to a supporting element of a wall formwork. Basically, at least one, preferably both, locking devices comprise an underside that is plane at least in some portions and is provided, in particular, by a dome plate, which rests flat against the wall formwork or a supporting element of the wall formwork in the assembled state. A threaded portion, which can be screwed to an anchoring rod end, is connected to the dome plate, preferably in a movable manner. The threaded portion can be moved relative to the dome plate, preferably in a manner similar to a joystick.

In one embodiment of the invention, the threaded portion of the locking device is non-rotatably attached to the dome plate. By this embodiment, it is accomplished that an end of an anchoring rod pushed into wall formworks can be rotated into the threaded portion without the threaded portion co-rotating in an undesired manner. This, in particular, is a locking device that is to be mounted in advance, i.e. attached, to the rear side of a wall formwork, in particular the holding formwork, in order to then connect, in particular to screw, to this locking device an end of the anchoring rod pushed through the closing and the holding formwork.

A supporting element of a wall formwork basically consists of a metallic hollow profile, in particular a profile with a rectangular, square or hat-shaped cross section. Walls of such a profile are provided with one or more anchoring rod bores for pushing through an anchoring rod that also lead through the formwork facing of the wall formwork.

Preferably, the locking device is attached to a supporting element which, in the erected state, extends vertically in order thus to be able to anchor, in particular, along the entire height of a holding formwork at a particularly suitable location.

Preferably, a locking device is attached at the beginning of an assembly to the rear side of a holding formwork, because this maximizes the speed of an assembly. After the closing formwork has been erected, a technician is located on the side of the closing formwork. He is then able to immediately install anchoring rods.

In one embodiment of the assembly, the one end of the anchoring rod has a plurality of grooves or bores that form the graduation. An adjusting nut is screwed onto this end. The adjusting nut holds a securing nut, in particular by means of a flange. This holding achieves that the securing nut can finally be screwed onto a threaded portion in such a way that the formwork connected to this threaded portion is moved into the desired position. A stop is pushed into one of the grooves or bores or is attached thereto in such a way that the stop cannot be displaced along the longitudinal axis of the anchor. The adjusting nut is moved by screwing towards the stop until it reaches the stop. The fixation can also be achieved by means of a frictional fit or non-positive fit. Preferably, however, the fixation takes place, alternatively or additionally, by positive fit. It is accomplished by the fixating process that the stop cannot drop out of its position. Further, it is achieved by reaching and fixating the stop that the desired position that has to be reached for producing a desired wall thickness is easily and reliably found. Subsequent thereto the securing nut is screwed onto a threaded portion connected to the rear side of the adjacent formwork. This formwork is thus moved into the desired position in order to be able to produce a wall with a desired wall thickness.

In this embodiment, the securing nut and the adjusting nut are located, in particular, between the stop and the formwork adjacent thereto.

In order to fixate the stop by positive fit, the stop preferably has a recess into which the adjusting nut can be moved with a portion by screwing. If this portion of the adjusting nut is located in the recess of the stop, the stop can no longer be disengaged from the groove or bore. Alternatively, however, the adjusting nut can also have a recess in which a part of the stop can end up in order thus to fixate. However, with regard to its construction, this embodiment requires a bit more effort.

An anchoring system suitable for carrying out the method comprises an anchoring rod and at least one locking device. One end of the anchoring rod comprises a graduation formed, in particular, by grooves and/or bores. A stop, an adjusting nut and a securing nut, in particular, are provided for this end of the anchoring rod. The system moreover comprises a threaded portion onto which the securing nut can be screwed. The threaded portion can be attached indirectly or directly to the rear side of a formwork. The threaded portion is preferably connected to the dome plate. In that case, the dome plate is preferably configured and adapted in such a way that it can be attached to the rear side of a formwork, in particular to a beam or bar of the formwork consisting of metal. Preferably, the anchoring system comprises for each end of the anchoring rod a locking device that can be disengaged from the anchoring rod.

In one embodiment, the locking device that is connected to the end of the anchoring rod has a sleeve or a bore through which the anchoring rod can be pushed for assembly without having to screw. With its end, which is provided for this purpose, the anchoring rod can thus be pushed through the two wall formworks particularly quickly for assembly.

In one embodiment, the sleeve comprises an outer thread that is screw-connected with a securing nut in order to connect to the sleeve the end of the anchoring rod that is not pushed through the wall formworks. In turn, the sleeve is indirectly or directly preferably connected to the rear side of the corresponding wall formwork. Preferably, the sleeve is connected to the dome plate in such a way that the sleeve can be moved like a joystick relative to the dome plate in order thus to be able to align the sleeve for a trouble-free guidance of the anchoring rod. In that case, the dome plate is preferably attached to the rear side of the corresponding wall formwork, generally to the rear side of a closing formwork, and preferably by means of a screw connection in order to be able to carry out an assembly quickly, easily and reliably.

In one embodiment, the locking device comprises an adjusting member, preferably an adjusting nut, which is screwed onto the end of the anchoring rod that has not been pushed through. The adjusting member is set in accordance with the graduation, preferably by screwing the adjusting nut up to the intended graduation. Particularly preferably, there is a stop that can be positioned in accordance with the graduation. The adjusting nut is then screwed towards the stop until the stop prevents further screwing. The anchoring rod is then pushed through the closing formwork and the holding formwork and connected to the locking device on the corresponding rear wall formwork. As a matter of principle, the rear formwork is the holding formwork. Now, the securing nut, which is suitably connected to the adjusting nut, is screwed onto the outer thread of the sleeve, preferably in the maximally possible manner. Thus, the corresponding wall formwork, which is preferably a closing formwork, is aligned exactly.

Preferably, the securing nut has wings in order to be able to quickly screw-connect the securing nut at least initially. If required, the securing nut is finally screw-connected by means of tools.

In one embodiment of the invention, grooves in the anchoring rod serve as the graduation. In this embodiment, in particular, a stop can be positioned quickly and reliably in accordance with the graduation by a wall portion of the stop reaching into a corresponding groove in the aligned state. In that case, the stop is held in its intended position in such a way that it is capable of serving as a stop for an adjusting member.

Preferably, the stop has an opening with a region that permits a quick displacement along the anchoring rod until a desired graduation position has been reached. Preferably, there is another region that tapers towards one end in order thus to be able to suspend the stop in a furrow or the groove of the graduation in a stable manner.

In order for the adjusting member or the adjusting nut and the securing nut to be able to be connected to each other in a particularly well-suited manner, both components comprise flanges that serve as stops with respect to each other. If the securing nut is screwed onto the sleeve with the outer thread, the flange of the securing nut is moved against the flange of the adjusting member. When the two flanges finally contact each other, a further tightening of the screw of the securing nut causes the associated wall formwork to be aligned.

In one embodiment, the graduation has markings that reflect the thickness of walls. The markings are provided, in particular, in the form of indications of numbers that correspond to the associated wall thicknesses. In one embodiment, for example, grooves of the graduation are provided with such markings.

In one embodiment, the stop has a recess into which a part of the adjusting nut can be moved during assembly. By this movement, the stop is prevented from disengaging from its position by a positive fit, and thus particularly reliably.

For stability reasons, the anchoring system basically consists of metal, or at least very predominantly of metal.

DETAILED DESCRIPTION

Advantageous embodiments of the invention are explained in more detail below.

Figure 1:
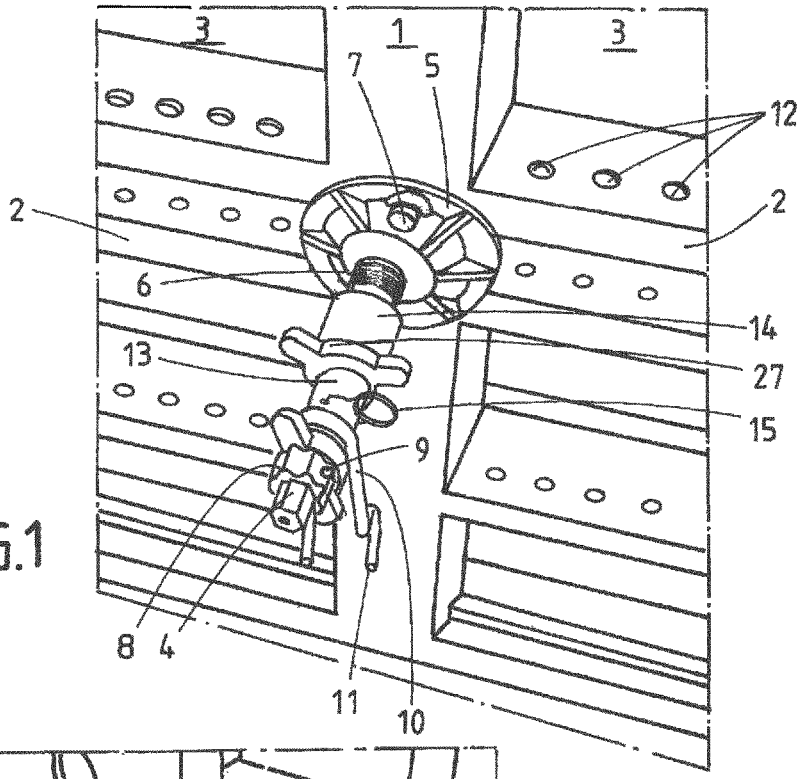
FIG. 1 is a perspective view of an exemplary formwork with an exemplary anchoring system according to the present invention.

FIG. 1 shows a section of the rear side of a closing formwork with a longitudinal beam 1 and crossbars 2 attached to the rear side of a formwork facing 3. An anchoring rod 4 is pushed into an anchoring rod bore and attached to the longitudinal beam 1 by means of a locking device. The locking device comprises a dome plate 5 to which a sleeve 6 with an outer thread is attached in such a way that the sleeve 6 can be moved in a joystick-like manner relative to the dome plate 5 in order thus to be able to align the sleeve 6 for the anchoring rod 4 in a suitable manner if required. The dome plate 5 is screwed to the longitudinal beam 1 by means of a screw 7. A double-wing nut 8 is screwed on at the end of the anchoring rod 4. The position of the double-wing nut 8 is fixated by a grooved pin 9 that leads into the anchoring rod 4 laterally from a bore of the nut 8 and is held frictionally by means of a press-fit. The double-wing nut makes it easier to screw the pushed-through end of the anchoring rod into a threaded portion of the locking device provided on the side of the holding formwork.

A suspension means 10 disposed adjacent to the double-wing nut 8 is connected to the anchoring rod 4. The two hook-shaped ends 11 of the suspension means 10 can be threaded into upper holes 12 in crossbars in order thus to be able to suspend the anchoring rod together with the locking device, which is visible in FIG. 1, and the double-wing nut 8 after dismantling, primarily ready to hand adjacent to the anchoring rod bore through which the anchoring rod 4 has been pushed.

The locking device comprises an adjusting nut 13, a, for example triple-winged, securing nut 14 with an inner thread that can be screwed onto the outer thread of the sleeve 6. The position of the adjusting nut at a suitable location on the anchoring rod can be fixated by means of a cotter pin 15. The anchoring rod comprises a plurality of bores through which the cotter pin 15 can be pushed. The bores form a graduation in order to be able to simply and quickly align wall formworks for typical wall thicknesses.

If the adjusting nut is fixated by means of a cotter pin 15, the securing nut 14 is screwed onto the threaded portion of the sleeve 6 in the maximally possible manner. The formwork 1, 2, 3 is thus moved into the position required for producing the desired wall with the desired wall thickness.

Figure 2:
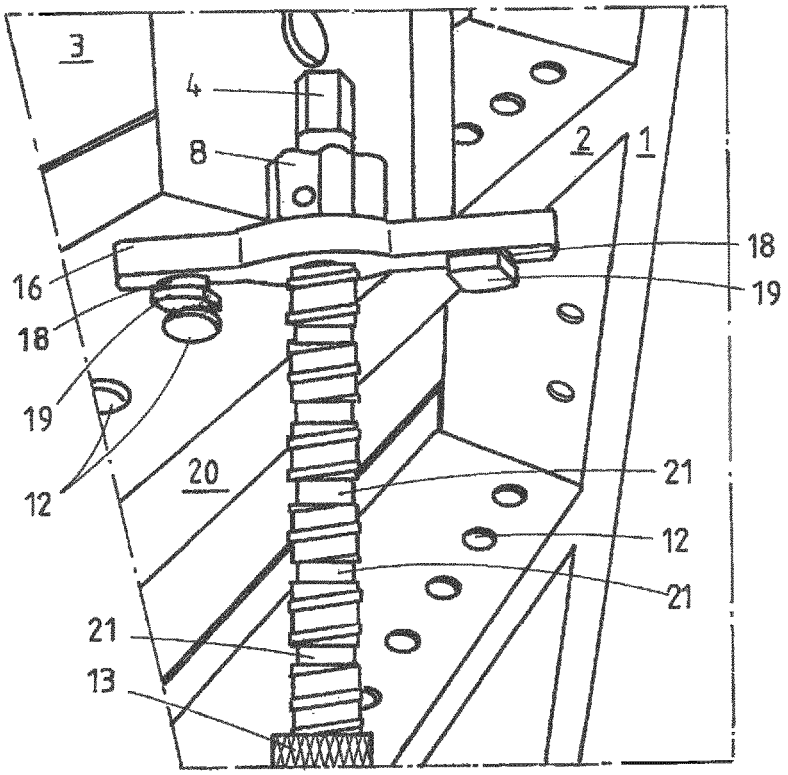
FIG. 2 is a perspective view of another exemplary anchoring system according to the present invention.
Figure 3:
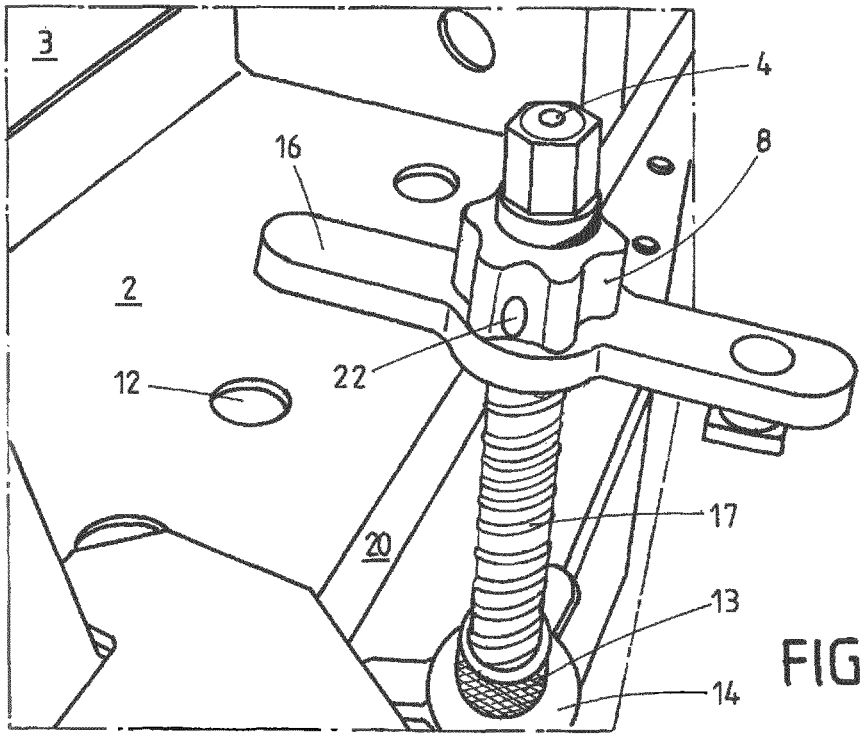
FIG. 3 is another perspective view thereof.
Figure 4:
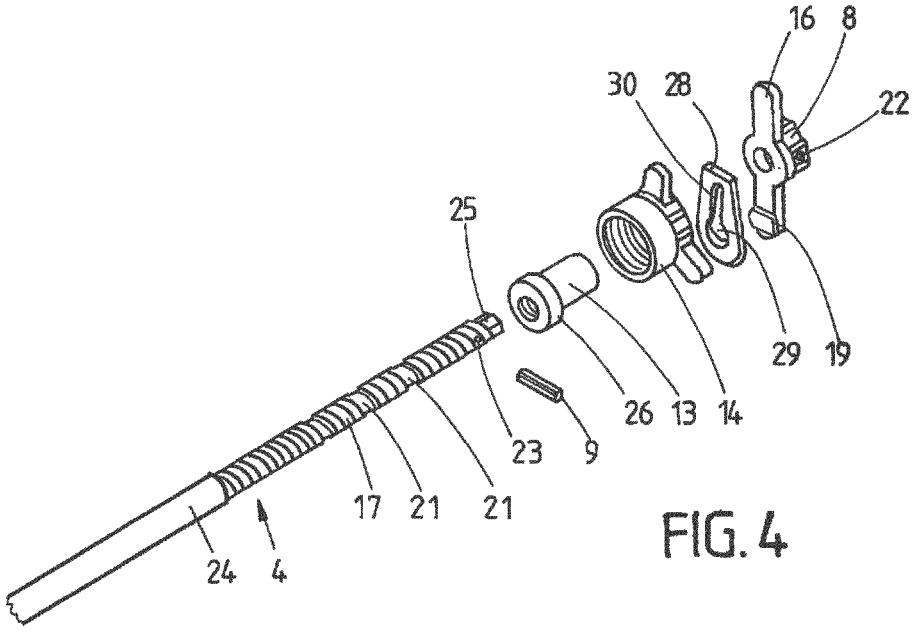
FIG. 4 is an exploded perspective view.

A particularly preferred embodiment is shown in the FIGS. 2, 3 and 4.

Using a wing 16 that protrudes perpendicularly from the end of the anchoring rod, a part of the anchoring system that was previously pulled out of the wall formwork can be suspended on a hole 12 of a crossbar 2, as the FIGS. 2 and 3 illustrate. Such a protruding wing 16 is preferably a part of the double-wing wing nut 8 that has been screwed onto the end of the threaded portion 17 of the anchoring rod 4. Each wing 16 has a suspension means with a first downwardly protruding region 18 with a circular diameter. At the lower end of the downwardly protruding region 18 of the suspension means, there is a plate-shaped, flat portion 19 of the suspension means which protrudes laterally from the wing 16 and perpendicularly from the region 18 with the circular diameter. Such a suspension means with the region 18 and the portion 19 can, as FIGS. 2 and 3 also show, be brought into a hole 12 of a side wall, which is accessible from the top, of a horizontally extending crossbar 2 in order thus to suspend the corresponding part of the anchoring system on the rear side of a closing formwork in the desired position in a reliable and stable manner. The region 18 with the circular cross section is adapted to the cross section of a hole 12 and fills it by more than 50% in the suspended state. The underside of each wing 16 is plane so that it is able, as is shown in FIG. 3, to rest flat on a side wall of a crossbar 2. The distance between the anchoring rod 4 with the threaded portion 17 and the suspension means with the region 18 corresponds to the distance of a hole 12 from the rear side 20 of the crossbar 2, so that an anchoring rod 4 with the thread 17 is adjacent to or rests on the crossbar 2 in the suspended state, which stabilizes the position of the suspended anchoring rod 4. As a whole, the part of the anchoring system that is being suspended is held in a stable position on the rear side of a closing formwork. Pivoting movements relative to the closing formwork are thus advantageously minimized.

The wings of the wing nut 8 can be used for manually twisting an anchoring rod at least initially. If the force required therefor increases too much, the head of the wing nut 8 can be twisted using tools.

The threaded portion 17 of the anchoring rod 4 is interrupted at regular intervals by a peripherally extending groove in order to be able to hook in a stop wedge.

FIGS. 2 and 3 show a hole 22 in the nut 8 into which a grooved pin 9 is driven. FIG. 4 shows a bore 23 in the anchoring rod 4 in which the driven-in grooved pin 9 ends up for fixation. The anchoring rod 4, which is shown in some portions in FIG. 4, comprises a smooth middle region 24 that is allowed to end up in the concrete of a concrete wall to be produced. The end 25 of the anchoring rod adjacent to the threaded portion 21 is advantageously configured in a multi-edged manner in order to be able to twist it additionally, if required, using tools, such as, for example, a spanner.

On one end, the adjusting nut 13 comprises a peripherally protruding flange 26 that serves as a stop for an inwardly directed flange 27 (see FIG. 1). The adjusting nut 13 comprises an inner thread that can be screwed onto the threaded portion 17 of the anchoring rod 4. A stop 28 has a recess with a round region 29 and an elongate further region 30 connected thereto, which tapers towards the end. The threaded portion 17 can be threaded into the round region. The elongate region can be suspended in the grooves 21. The grooves 21 form a graduation in order to be able to make the alignment of wall formworks for typical wall thicknesses quick and easy. In that case, the stop 28 is secured against displacement along the anchoring rod 4. Preferably, the adjusting nut 13 also comprises a region configured in a multi-edged manner in order to be able to screw-connect the adjusting nut by means of tools.

FIG. 4 shows the components of an anchoring system that are pulled out for dismantling and suspended. In that case, it is generally not necessary, advantageously, to disengage connections between dome plates and wall formworks.

Figure 5:
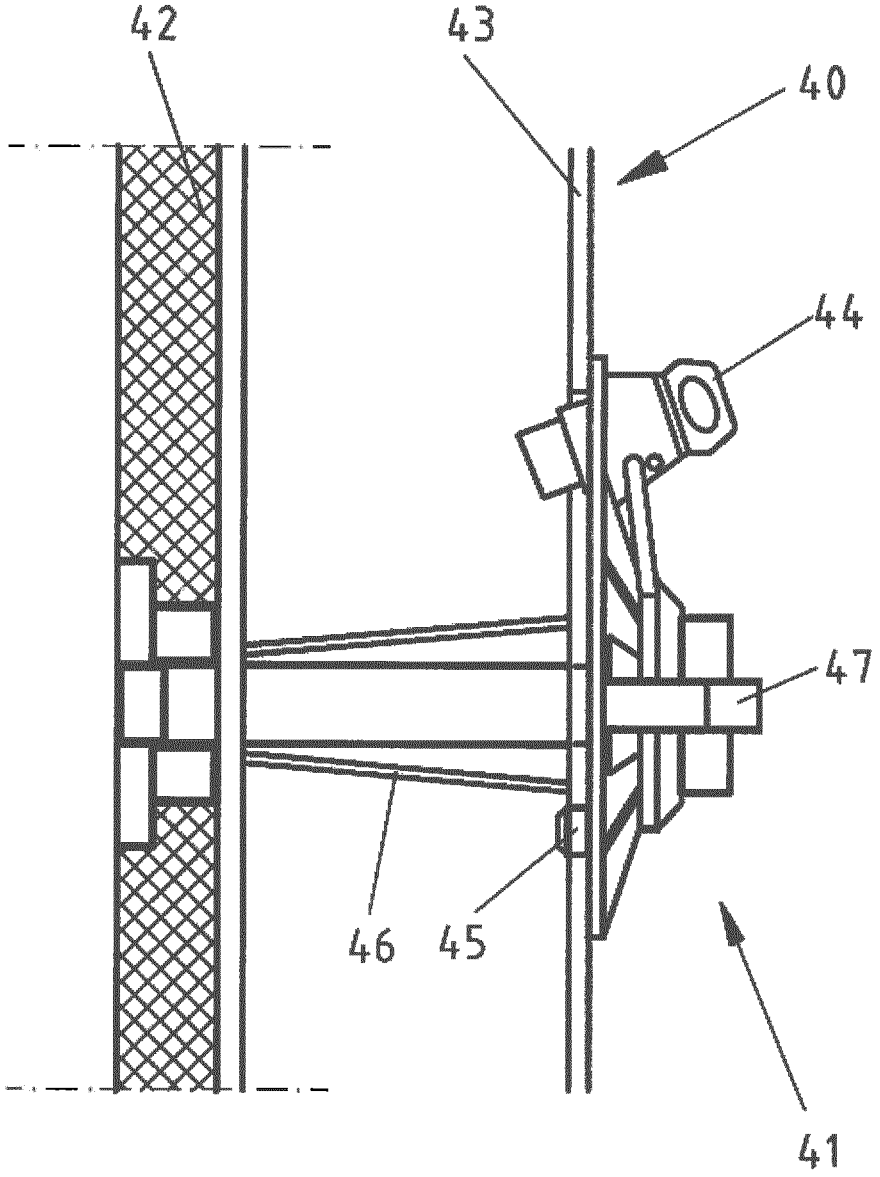
FIG. 5 is an elevational view of the formwork with an anchoring rod installed.

FIG. 5 shows a section of a holding formwork 40 with a locking device 41 attached thereto. On the front side, the holding formwork 40 has a formwork facing 42. The locking device 41 is attached to a longitudinal beam 43 by means of a screw 44 and a bolt 45 that suitably engage holes in the longitudinal beam. The screw 44 is positioned obliquely in such a manner that no threaded portion in the corresponding hole of the longitudinal beam 43 is required for attaching the locking device 41 to the longitudinal beam 43. For connection with an anchoring rod, the locking device 41 is suitably disposed above an anchoring rod bore 46 through which the end 48 of an anchoring rod 4 is pushed for assembly. After the end 46 of an anchoring rod 4 has been pushed through the bore 46, that end 48 is then connected, generally by a screw connection, to the locking device 41.

Figure 6:
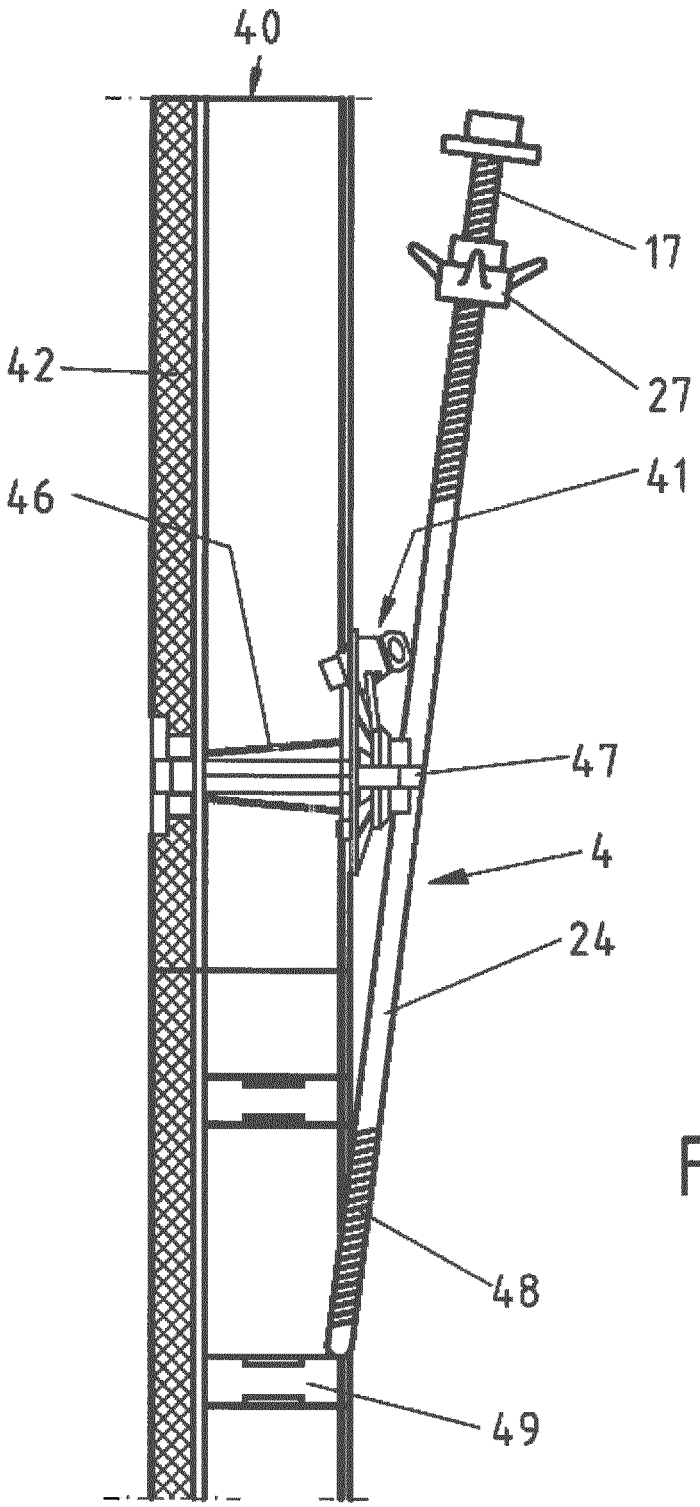
FIG. 6 is an elevational view showing the anchoring rod in a storage position.

The locking device has a region 47 through which a bore leads vertically or at least substantially vertically and which is therefore not visible in the FIGS. 5 and 6.

FIG. 6 illustrates that a bore in the corresponding locking device 41 is sufficient in order to realize the advantage that the anchoring system with the anchoring rod 4 can be held ready to hand at a particularly suitable location for an assembly without having to exert any great technical effort. The bore in the region 47 not only makes it possible to attach the part 4, 27 of the anchoring system that can be pulled out to this locking device 41, and thus also to the rear side of the holding formwork 40, if this locking device 41, as shown in FIGS. 5 and 6, is attached to the rear side of a longitudinal beam 43. Furthermore, it is possible to attach the part 4, 27 of the anchoring system that can be pulled out in such a way that, as is shown in FIG. 6, it is held in a stable manner.

The bore is disposed and configured in such a way that the anchoring rod 4 extends substantially vertically in the depicted erected state of the holding formwork 40 when the anchoring rod 4, as is shown in FIG. 6, has been inserted into the bore and the locking device 41 is attached to the rear side of the holding formwork 40.

Furthermore, the bore is configured in such a way that the end 48 of the anchoring rod 4 that is pushed through the bore during dismantling, for example, sets down on a crossbar 49 of the wall formwork 40. As is shown, the end 48 that has been pushed through does not protrude over the rear side the wall formwork 40.

The bore is configured in such a way that, as shown, the anchoring rod 4 includes an acute angle with the rear side of the wall formwork 40 when the anchoring rod 4 has been attached to the locking device 41. The part of the anchoring system that must be grasped for pulling out the part 4, 27 of the anchoring system that can be pulled out is in that case ready to hand in a particularly simple manner.

Figure 7:
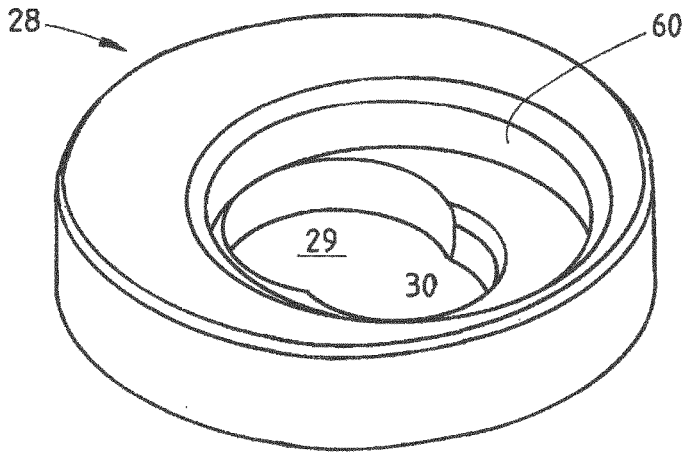
FIG. 7 is a perspective view of an exemplary stop used in the anchoring system.

FIG. 7 shows a particularly preferred embodiment of a stop 28. Matching the stop 28 shown in FIG. 4, it has a recess or passage with a region 29. A region 30, which passes through the stop and has a smaller diameter than the region 29, is connected thereto. The region 30 can thus be suspended on a groove 21 of an anchoring rod in such a way that the stop 28 can no longer be displaced along the anchoring rod. The diameter of the region 30 is selected in such a way that the anchoring rod can be pushed through it. If the adjusting nut 13 shown in FIG. 4 is now moved towards the stop 28, the part of the adjusting nut 13 that protrudes from the flange 26 ends up in the recess 60. The recess 60 is adjacent to the two recesses or passageways 29 and 30 in such a way that the stop 28 can no longer be disengaged from the anchoring rod when the above-mentioned part of the adjusting nut 13 has been screwed into the recess 60. The stop 28 is in that case fixated by positive fit.

FIG. 7 illustrates that the passage 29 with the larger diameter is adjacent to the edge of the recess 60. The passage 30 with the smaller diameter is not adjacent to the edge of the recess 60. This makes the desired fixation possible. Generally, the passage 29 with the larger diameter comes up closer to the edge of the recess 60 than the passage 30 with the smaller diameter, in order to enable in a technically simple manner the positive fixation.

Figure 8:
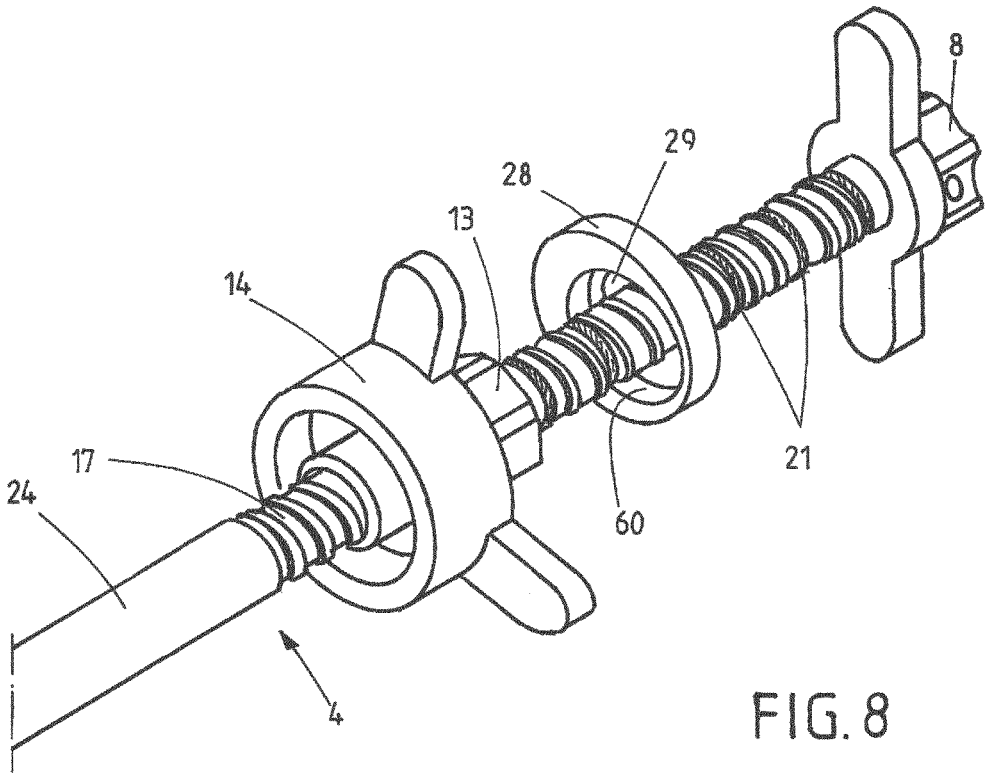
FIG. 8 is fragmentary perspective view showing an anchoring rod and associated components.

If the adjusting nut 13 shown in FIG. 8 is screwed into the recess 60 of the stop 28 as is shown, the stop 28 is fixated. In that case, the stop 28 can no longer be released from the position shown. The region of the adjusting nut 13 that protrudes from the flange 28 is preferably configured in a multi-edged manner. If the adjusting nut has been moved into the recess 60 in the maximally possible manner, a region configured in a multi-edged manner remains between the stop 26 and the securing nut 14, which can be reached by a tool in order to be able to screw-connect the adjusting nut 13 by means of tools.

The invention claimed is:

1. A method for mounting a wall formwork including a first and a second formwork and an anchoring system, the method comprising the steps:

a. placing the first and second wall formworks opposite from each other, b. inserting an anchoring rod with a graduation partway through anchoring rod bores of the first and second wall formworks in such a way that an end portion of the anchoring rod having the graduation protrudes from the first wall formwork, the graduation being formed by a plurality of grooves or bores longitudinally space apart along a longitudinal axis of the anchoring rod, c. connecting an end of the anchoring rod opposite said end portion of the anchoring rod to a first locking device on the second wall formwork, and d. connecting said end portion of the anchoring rod to a second locking device on the first wall formwork, wherein step d includes:

pushing a stop into one of the grooves or bores in such a way that the stop cannot be displaced from said one of the grooves or bores along the longitudinal axis of the anchoring rod, screwing the adjusting nut along a threaded portion of the anchoring rod towards the stop until the adjusting nut reaches a position securing the stop in said one of the grooves or bores, and then screwing a securing nut onto a threaded portion connected to the first wall formwork.

2. The method according to claim 1, wherein, while the anchoring rod is pushed through, the adjusting member, the securing nut and the stop are connected to the anchoring rod.

3. The method according to claim 1, wherein a wing nut is screwed onto an outermost end of said end portion before the anchoring rod is inserted into the anchoring rod bores in the first and second wall formworks.

4. The method according to claim 1, wherein, step b includes inserting the anchoring rod through a dome plate of one of the first and second locking devices.

5. An anchoring system comprising:

an anchoring rod having a graduation for producing walls of a desired thickness, the graduation being formed by a plurality of grooves or bores on or in the anchoring rod, an adjusting member that is internally threaded for screwing onto a threaded end portion of the anchoring rod, a cotter pin or a stop for engaging a selected one of the plurality of grooves or bores, wherein the adjusting member can be positioned to retain the cotter pin or the stop in the selected one of the plurality of grooves or bores, and a securing nut internally threaded for securing onto the threaded end portion of the anchoring rod, wherein screwing the securing nut onto the threaded end portion causes the securing nut to be pressed against the adjusting member.

6. The anchoring system according to claim 5, further comprising a wing nut threaded onto the end portion of the anchoring rod.

7. The anchoring system according to claim 5, wherein the anchoring system comprises the stop and the grooves, the stop having a first and a second passage, wherein the first passage has a smaller diameter than the second passage, wherein the first and second passages are connected to each other in such a way that the anchoring rod can be relatively moved back and forth between the first and second passages when aligned with the selected one of the grooves, and wherein the adjusting nut is screwable along the threaded end portion of the anchoring rod for fixating the stop in a positive manner.

* * * * *